US011491502B2

(12) United States Patent
Morizono

(10) Patent No.: US 11,491,502 B2
(45) Date of Patent: Nov. 8, 2022

(54) TWO FLUID SPRAY EQUIPMENT

(71) Applicant: TOSHIBA MITSUBISHI-ELECTRIC INDUSTRIAL SYSTEMS CORPORATION, Chuo-ku (JP)

(72) Inventor: Yasushi Morizono, Tokyo (JP)

(73) Assignee: TOSHIBA, MITSUBISHI-ELECTRIC INDUSTRIAL SYSTEMS CORPORATION, Tokyo (JP)

( * ) Notice: Subject to any disclaimer, the term of this patent is extended or adjusted under 35 U.S.C. 154(b) by 158 days.

(21) Appl. No.: 16/482,354

(22) PCT Filed: Jul. 27, 2017

(86) PCT No.: PCT/JP2017/027331
§ 371 (c)(1),
(2) Date: Jul. 31, 2019

(87) PCT Pub. No.: WO2018/179474
PCT Pub. Date: Oct. 4, 2018

(65) Prior Publication Data

US 2020/0171526 A1 Jun. 4, 2020

(30) Foreign Application Priority Data

Mar. 27, 2017 (JP) ..... JP2017-061003

(51) Int. Cl.
*B05B 12/08* (2006.01)
*B05B 7/12* (2006.01)

(52) U.S. Cl.
CPC ..... *B05B 12/082* (2013.01); *B05B 7/1254* (2013.01)

(58) Field of Classification Search
CPC ..... B05B 12/082; B05B 7/1254; B05B 12/12; B05B 7/12; B05B 7/32; B05B 7/0416
(Continued)

(56) References Cited

U.S. PATENT DOCUMENTS 9,421,559 B2 * 8/2016 Cornett ..... B05B 7/0416
2007/0075163 A1 * 4/2007 Smith ..... B05B 12/085 239/124
2013/0153676 A1 * 6/2013 Ballu ..... A01C 23/007 239/11

FOREIGN PATENT DOCUMENTS

FR 3060257 A1 * 12/2016 ..... G05D 16/2026
JP S58-161660 U 10/1983
(Continued)

OTHER PUBLICATIONS

English translation of FR3060257A1 (Year: 2016).*
(Continued)

*Primary Examiner* — Qingzhang Zhou
(74) *Attorney, Agent, or Firm* — Xsensus LLP

(57) ABSTRACT

A two fluid spray equipment includes: two fluid nozzles of a plurality of systems; a water supply apparatus for supplying the pressurized water at common pressure; a compressed air supply apparatus for supplying the compressed gas at common pressure; and a plurality of spray control units for controlling spray of the two fluid nozzle of each of the plurality of systems, wherein each of the plurality of spray control units includes a water pressure control unit for performing control to reduce pressure of the pressurized water supplied from the water supply apparatus based on a spray command value without pressurization, and an air pressure control unit for controlling pressure of the compressed gas supplied from the compressed air supply apparatus based on the spray command value.

6 Claims, 8 Drawing Sheets

(58) Field of Classification Search
USPC ..... 239/314, 306, 61, 68, 69
See application file for complete search history.

(56) References Cited

FOREIGN PATENT DOCUMENTS

| | | | |
|---|---|---|---|
| JP | 2007-139403 | A | 6/2007 |
| JP | 2014-23976 | A | 2/2014 |
| JP | 2015-102249 | A | 6/2015 |
| KR | 10-0432509 | B1 | 5/2004 |

OTHER PUBLICATIONS

Office Action dated Nov. 25, 2020, in corresponding Korean patent Application No. 10-2019-7030397, 10 pages.
International Search Report dated Oct. 10, 2017 in PCT/JP2017/027331 filed on Jul. 27, 2017.
Office Action dated Jun. 18, 2021 in Chinese patent Application No. 201780088747.9.

* cited by examiner

| WATER PRESSURE (kPa) | SPRAY AMOUNT (mL/min) | | | | |
|---|---|---|---|---|---|
| | 0 | 25 | 50 | 75 | 100 |
| | AIR PRESSURE (kPa) | | | | |
| 500 | 700 | 675 | 650 | 625 | 620 |
| 450 | 648 | 626 | 604 | 582 | 560 |
| 400 | 580 | 560 | 540 | 520 | 500 |

FIG. 2

| WATER PRESSURE (kPa) | | | SPRAY AMOUNT (mL/min) | | | | |
|---|---|---|---|---|---|---|---|
| | | | 0 | 25 | 50 | 75 | 100 |
| 500 | AIR PRESSURE | kPa | 700 | 675 | 650 | 625 | 620 |
| | AIR AMOUNT | NL/min | 35 | 32 | 29 | 26 | 24 |
| 450 | AIR PRESSURE | kPa | 648 | 626 | 604 | 582 | 560 |
| | AIR AMOUNT | NL/min | 32 | 29 | 26 | 23 | 20 |
| 400 | AIR PRESSURE | kPa | 580 | 560 | 540 | 520 | 500 |
| | AIR AMOUNT | NL/min | 30 | 27 | 24 | 21 | 18 |

FIG. 4

| WATER PRESSURE (kPa) | | | SPRAY AMOUNT (mL/min) | | | | |
|---|---|---|---|---|---|---|---|
| | | | 0 | 25 | 50 | 75 | 100 |
| 500 | AIR PRESSURE | kPa | 700 | 675 | 650 | 625 | 620 |
| | AIR AMOUNT | NL/min | 35 | 32 | 29 | 26 | 24 |
| | AVERAGE PARTICLE SIZE | μm | 5 | 6 | 7 | 8 | 9 |
| 450 | AIR PRESSURE | kPa | 648 | 626 | 604 | 582 | 560 |
| | AIR AMOUNT | NL/min | 32 | 29 | 26 | 23 | 20 |
| | AVERAGE PARTICLE SIZE | μm | 7 | 8 | 9 | 10 | 11 |
| 400 | AIR PRESSURE | kPa | 580 | 560 | 540 | 520 | 500 |
| | AIR AMOUNT | NL/min | 30 | 27 | 24 | 21 | 18 |
| | AVERAGE PARTICLE SIZE | μm | 9 | 10 | 11 | 12 | 13 |

FIG. 6

TWO FLUID SPRAY EQUIPMENT

FIELD

The present disclosure relates to a two fluid spray equipment.

BACKGROUND

Generally, a two fluid spray equipment is disclosed in which a compressed gas and a pressurized liquid are supplied to a two fluid nozzle and sprayed.

For example, a two fluid spray equipment is disclosed in which when a pressurized liquid remaining in a pressurized liquid supply system is insufficient, a replenishing liquid from a liquid replenishing system is supplied to the pressurized liquid supply system at higher pressure than that of the pressurized liquid from the pressurized liquid supply system using a compressed gas from a compressed gas supply system, and the pressurized liquid from the pressurized liquid supply system is continuously sprayed at constant supply pressure (see PTL 1).

Also, a two fluid spray equipment is disclosed in which pressure of a compressed gas from a compressed gas supply system can be applied to a pressurized liquid supply system at any level, and pressure of a liquid is controlled to be constant by the compressed gas (see PTL 2).

However, the two fluid spray equipment requires water pressure control with high accuracy at pressure of about 0.5 MPa to control a property of mist to be sprayed. For example, in a fluid spray equipment including a plurality of spray control systems, each spray control system performing water pressure control with high accuracy at pressure of about 0.5 MPa increases manufacturing and operational costs. On the other hand, performing water pressure control with high accuracy of common water to be supplied to the plurality of spray control systems disables control of the property of mist for each spray control system.

CITATION LIST

Patent Literature

[PTL 1] JP2014-23976A
[PTL 2] JP2015-102249A

SUMMARY

An object of the present disclosure is to provide a two fluid spray equipment that controls a property of mist for each of a plurality of spray control systems to reduce manufacturing and operational costs.

A two fluid spray equipment according to an aspect of the present disclosure includes: two fluid nozzles of a plurality of systems for mixing and spraying pressurized water and a compressed gas; pressurized water supply means for supplying the pressurized water at common pressure to the two fluid nozzles of the plurality of systems; compressed gas supply means for supplying the compressed gas at common pressure to the two fluid nozzles of the plurality of systems; and a plurality of spray control means for controlling spray of the two fluid nozzle of each of the plurality of systems, wherein each of the plurality of spray control means includes water pressure control means for performing control to reduce pressure of the pressurized water supplied from the pressurized water supply means based on a spray command value for controlling the spray without pressurization, and gas pressure control means for controlling pressure of the compressed gas supplied from the compressed gas supply means based on the spray command value.

BRIEF DESCRIPTION OF DRAWINGS

FIG. 2 shows a relationship among a spray amount, water pressure, and air pressure used by a calculation processing unit according to the first embodiment.

FIG. 4 shows a relationship among a spray amount, water pressure, air pressure, and an air amount used by a calculation processing unit according to the second embodiment.

FIG. 6 shows a relationship among a spray amount, water pressure, air pressure, an air amount, and an average particle size used by a calculation processing unit according to the third embodiment.

DESCRIPTION OF EMBODIMENTS

First Embodiment

Figure 1:
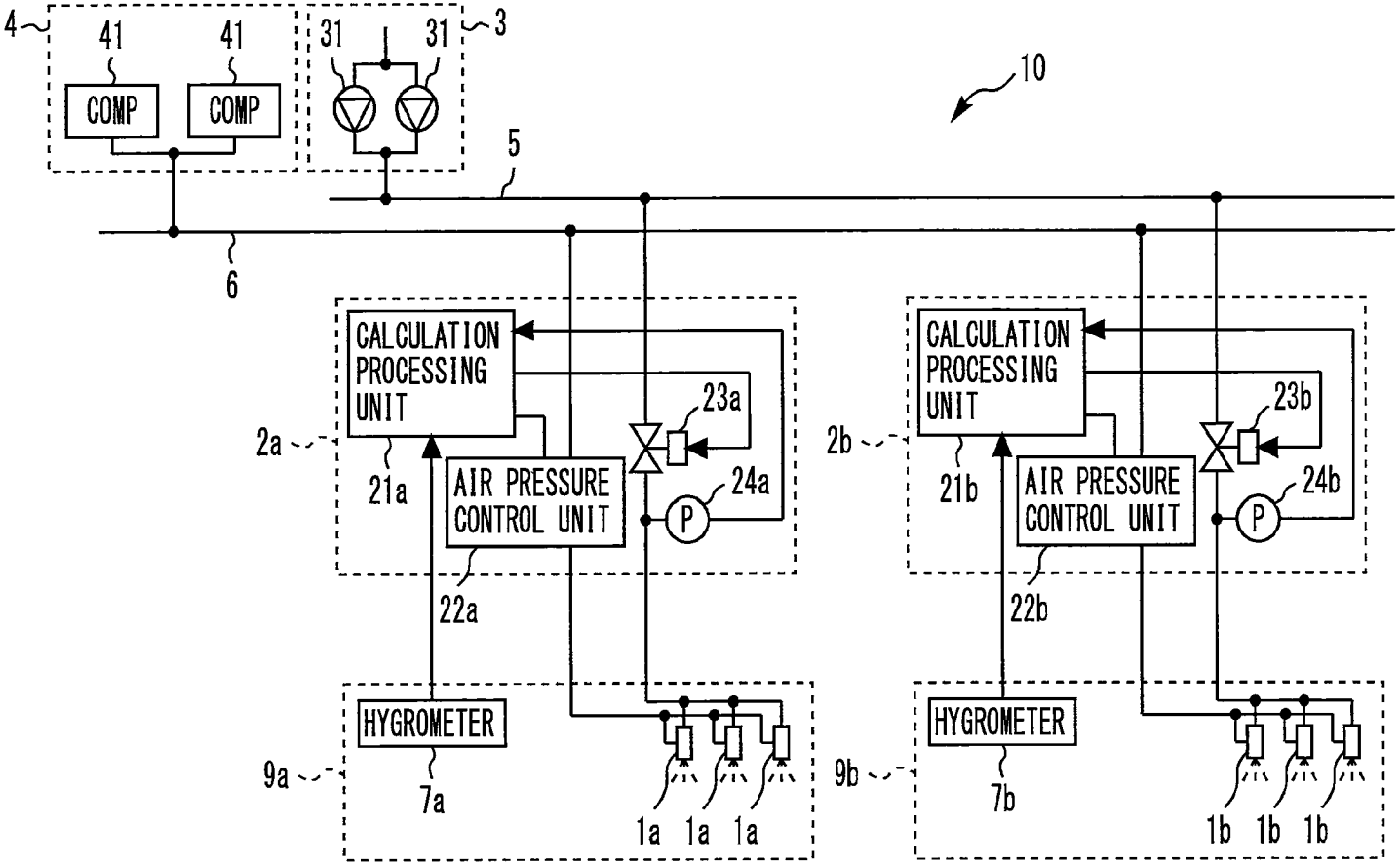
FIG. 1 shows a configuration of a two fluid spray equipment according to a first embodiment of the present disclosure.

FIG. 1 shows a configuration of a two fluid spray equipment 10 according to a first embodiment of the present disclosure. The same components in the drawings are denoted by the same reference numerals and differences will be mainly described.

The two fluid spray equipment 10 adjusts humidity of two spaces 9*a*, 9*b*. The two fluid spray equipment 10 may simultaneously perform temperature adjustment such as cooling or heating as long as it perform humidification. The spaces 9*a*, 9*b* may be or may not be partitioned, or may be the same space.

The two fluid spray equipment 10 includes two A and B spray control systems. The two fluid spray equipment 10 may include any number of spray control systems. The two fluid spray equipment 10 includes a plurality of A-system two fluid nozzles 1*a*, a plurality of B-system two fluid nozzles 1*b*, an A-system spray control unit 2*a*, a B-system spray control unit 2*b*, a water supply apparatus 3, a compressed air supply apparatus 4, a water supply passage 5, an air supply passage 6, and hygrometers 7*a*, 7*b*.

The two fluid nozzles 1*a*, 1*b* mix a liquid and a gas and spray a misty fluid. In this embodiment, the liquid is water and the gas is air. For example, the water is pure water obtained by refining tap water or the like. The A-system two fluid nozzle 1*a* is provided in the A-system space 9*a*. The B-system two fluid nozzle 1*b* is provided in the B-system space 9*b*.

The water supply apparatus 3 pressurizes and supplies the water to be sprayed from the two fluid nozzles 1*a*, 1*b*. In the water supply apparatus 3, devices such as water supply pumps 31 are duplexed to improve reliability, but do not need to be duplexed.

The compressed air supply apparatus 4 feeds compressed air to the two fluid nozzles 1*a*, 1*b*. In the compressed air supply apparatus 4, devices such as compressors 41 are duplexed to improve reliability, but do not need to be duplexed.

The water supply passage 5 is provided so that the water supplied from the water supply apparatus 3 is supplied through the spray control units 2*a*, 2*b* to the two fluid nozzles 1*a*, 1*b*.

The air supply passage 6 is provided so that the compressed air supplied from the compressed air supply apparatus 4 is supplied through the spray control units 2*a*, 2*b* to the two fluid nozzles 1*a*, 1*b*.

The A-system hygrometer 7*a* is provided in the A-system space 9*a*. The B-system hygrometer 7*b* is provided in the B-system space 9*b*. The hygrometers 7*a*, 7*b* measure humidities of the spaces 9*a*, 9*b* in which the hygrometers 7*a*, 7*b* are respectively provided. The hygrometers 7*a*, 7*b* transmit the measured humidities to the spray control units 2*a*, 2*b*, respectively.

The spray control units 2*a*, 2*b* control spray of the two fluid nozzles 1*a*, 1*b* based on the humidities measured by the hygrometers 7*a*, 7*b* and pressure of the water supplied from the water supply apparatus 3. The A-system spray control unit 2*a* controls spray of the A-system two fluid nozzle 1*a*. The B-system spray control unit 2*b* controls spray of the B-system two fluid nozzle 1*b*.

The A-system spray control unit 2*a* includes a calculation processing unit 21*a*, an air pressure control unit 22*a*, a valve 23*a*, and a water pressure measuring device 24*a*. The B-system spray control unit 2*b* includes a calculation processing unit 21*b*, an air pressure control unit 22*b*, a valve 23*b*, and a water pressure measuring device 24*b*. The B-system spray control unit 2*b* is configured similarly to the A-system spray control unit 2*a*, and thus the A-system spray control unit 2*a* will be mainly described below.

The valve 23*a* is provided midway of the water supply passage 5 through which the water supplied from the water supply apparatus 3 is supplied to the A-system two fluid nozzle 1*a*. The valve 23*a* opens/closes the water supply passage 5 or adjusts a flow rate of the water flowing through the water supply passage 5. The valve 23*a* may be of any type as long as it can open/close the water supply passage 5. For example, the valve 23*a* is a two-way valve or a regulator. No valve 23*a* may be provided.

The water pressure measuring device 24*a* is provided midway of the water supply passage 5 through which the water supplied from the water supply apparatus 3 is supplied to the A-system two fluid nozzle 1*a*. The water pressure measuring device 24*a* measures pressure of the water flowing through the water supply passage 5. The water pressure measuring device 24*a* transmits the measured water pressure to the calculation processing unit 21*a*.

The calculation processing unit 21*a* performs calculation processing in the A-system spray control unit 2*a*. The calculation processing unit 21*a* calculates pressure of the compressed air to be supplied to the A-system two fluid nozzle 1*a* based on a command value of a spray amount and the water pressure measured by the water pressure measuring device 24*a*. The command value of the spray amount is determined based on the humidity measured by the hygrometer 7*a*. The calculation processing unit 21*a* generates an air pressure command value for controlling the pressure of the compressed air based on the calculated air pressure. The calculation processing unit 21*a* outputs the generated air pressure command value to the air pressure control unit 22*a*.

The air pressure control unit 22*a* controls the pressure of the compressed air based on the air pressure command value calculated by the calculation processing unit 21*a* and supplies the air to the A-system two fluid nozzle 1*a*.

FIG. 2 shows a relationship among a spray amount, water pressure, and air pressure used by the calculation processing unit 21*a* according to this embodiment.

Here, a rated spray amount (100%) is 100 mL/min, and the command value of the spray amount is 0%, 25%, 50%, 75%, or 100%.

The calculation processing unit 21*a* stores a table representing the relationship in FIG. 2. For example, when the water pressure measured by the water pressure measuring device 24*a* is 400 kPa and the command value of the spray amount is 50%, the pressure of the compressed air needs to be 540 kPa. Then, the calculation processing unit 21*a* sets the air pressure command value to 540 kPa, and thus the compressed air at the pressure of 540 kPa is supplied to the A-system two fluid nozzle 1*a*. Thus, the spray amount of the A-system two fluid nozzle 1*a* becomes 50 mL/min.

The water supply apparatus 3 supplies the water at the pressure of 500 kPa, 450 kPa, or 400 kPa in FIG. 2. Thus, if the water pressure measured by the water pressure measuring device 24*a* is any of these values, the calculation processing unit 21*a* directly determines the air pressure command value from the stored table.

Next, the case where the water supply pressure of the water supply apparatus 3 varies will be described.

It is assumed that when the command value of the spray amount is 50% (50 mL/min), the measured water pressure is 425 kPa. In this case, the table does not include air pressure at the water pressure of 425 kPa, and thus the calculation processing unit 21*a* calculates the air pressure command value as described below.

The calculation processing unit 21*a* obtains, from the table, air pressures when the water pressure is higher than and lower than the measured water pressure for the command value of the spray amount. The water pressure higher than the measured water pressure of 425 kPa by one level is 450 kPa, and the water pressure lower than 425 kPa by one level is 400 kPa. When the spray amount is 50% and the water pressure is 450 kPa, the air pressure is 604 kPa. When the spray amount is 50% and the water pressure is 400 kPa, the air pressure is 540 kPa.

When the measured water pressure is Pm, water pressure higher than Pm is Pwu, water pressure lower than Pm is Pwd, air pressure at the water pressure of Pwu for the command value of the spray amount is Pau, and air pressure at the water pressure of Pwd for the command value of the spray amount is Pad, the air pressure command value is obtained by the following expression:

$$\text{Air pressure command value} = (Pm - Pwd)/(Pwu - Pm) \times (Pau - Pad) \qquad \text{Expression (1)}$$

From the expression, air pressure command value=(425−400)/(450−425)×(604−540)=572 kPa is obtained.

The calculation processing unit 21*a* sets the air pressure command value to 572 kPa, and thus the air pressure control unit 22*a* supplies the compressed air at the pressure of 572 kPa to the A-system two fluid nozzle 1*a*. Thus, even if the water supply pressure of the water supply apparatus 3 varies, the spray amount of the A-system two fluid nozzle 1*a* is maintained at 50%.

According to this embodiment, the water pressure applied to the two fluid nozzles 1*a*, 1*b* is measured, and the pressure of the compressed air is controlled based on the measured water pressure, thereby allowing the spray amounts of the two fluid nozzles 1*a*, 1*b* to be controlled. This allows variations in the water pressure, and thus the water supply apparatus 3 does not need to be able to control the water supply pressure with high accuracy. Therefore, manufacturing costs of the two fluid spray equipment 10 can be reduced.

Second Embodiment

Figure 3:
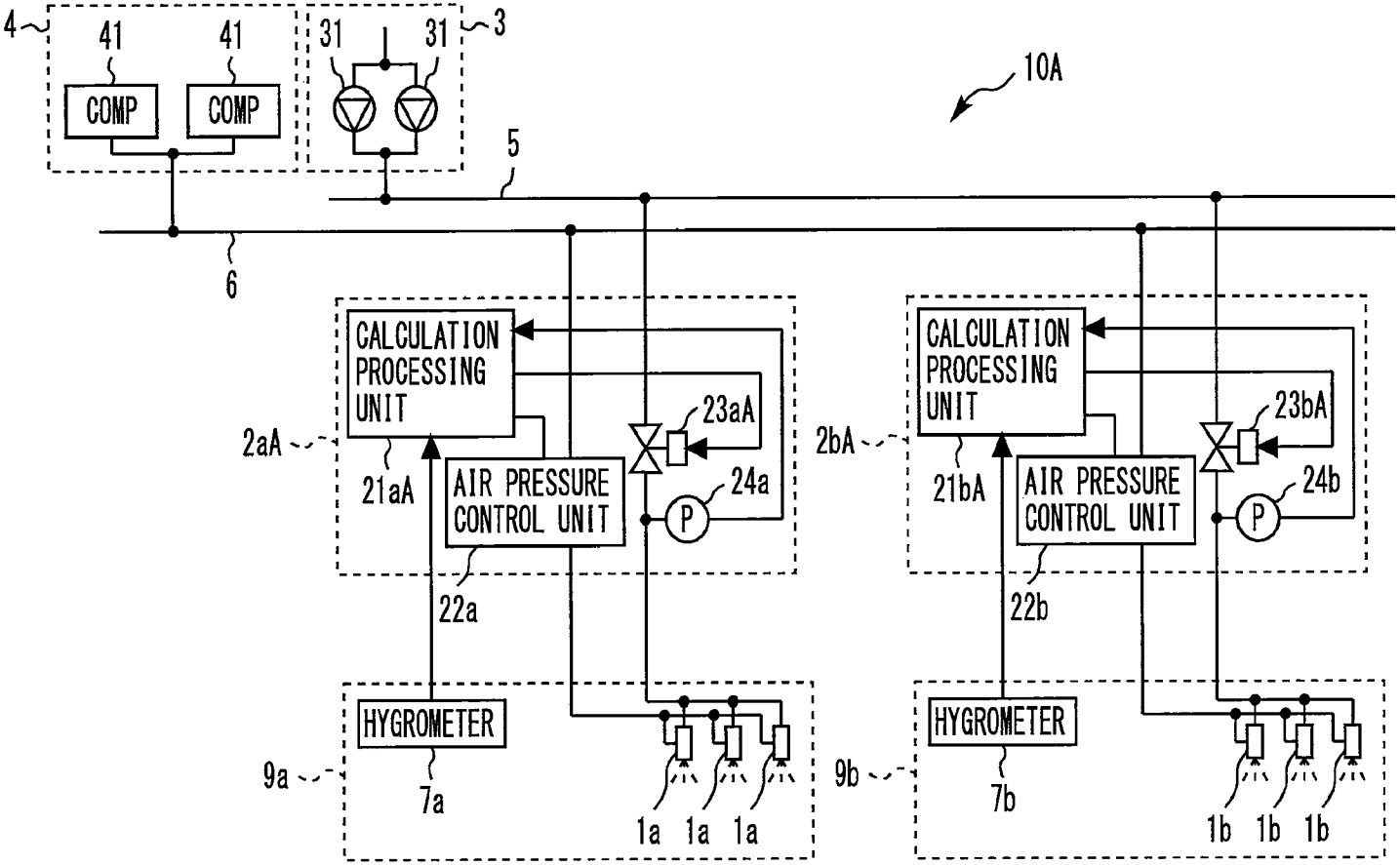
FIG. 3 shows a configuration of a two fluid spray equipment according to a second embodiment of the present disclosure.

FIG. 3 shows a configuration of a two fluid spray equipment 10A according to a second embodiment of the present disclosure.

The two fluid spray equipment 10A includes spray control units 2*a*A, 2*b*A instead of the two spray control units 2*a*, 2*b* in the two fluid spray equipment 10 according to the first embodiment in FIG. 1. Other points are similar to those in the two fluid spray equipment 10 according to the first embodiment.

The A-system spray control unit 2*a*A includes a control valve 23*a*A instead of the valve 23*a* and a calculation processing unit 21*a*A instead of the calculation processing unit 21*a* in the A-system spray control unit 2*a* according to the first embodiment. Other points are similar to those in the A-system spray control unit 2*a* according to the first embodiment.

The B-system spray control unit 2*a*B includes a control valve 23*b*A instead of the valve 23*b* and a calculation processing unit 21*b*A instead of the calculation processing unit 21*b* in the B-system spray control unit 2*b* according to the first embodiment. Other points are similar to those in the B-system spray control unit 2*b* according to the first embodiment.

The B-system spray control unit 2*b*A is configured similarly to the A-system spray control unit 2*a*A, and thus the A-system spray control unit 2*a*A will be mainly described below.

The control valve 23*a*A controls water pressure based on a water pressure command value calculated by the calculation processing unit 21*a*A, and supplies water to the A-system two fluid nozzle 1*a*.

FIG. 4 shows a relationship among a spray amount, water pressure, air pressure, and an air amount used by the calculation processing unit 21*a*A according to this embodiment. FIG. 4 shows data of the air amount in addition to the relationship in FIG. 2.

The calculation processing unit 21*a*A stores a table representing the relationship in FIG. 4. The calculation processing unit 21*a*A determines a water pressure command value and an air pressure command value in two operation modes of normal and energy saving operations. The operation modes may be switched based on a command value of the spray amount, manually, or by other methods. For example, when the command value of the spray amount becomes low such as 0%, the operation mode is switched from the normal operation to the energy saving operation. The operation of the calculation processing unit 21*a*A in the normal operation is similar to that of the calculation processing unit 21*a* according to the first embodiment.

Next, the operation of the calculation processing unit 21*a*A in the energy saving operation will be described.

The case will be described where the equipment is operated in the normal operation at the command value of the spray amount of 0%, the water pressure of 500 kPa, and the air pressure of 700 kPa and the mode is switched from the normal operation to the energy saving operation.

The calculation processing unit 21*a*A calculates a water pressure command value so as to reduce the water pressure from 500 kPa to 400 kPa. The calculation processing unit 21*a*A also calculates an air pressure command value corresponding to the water pressure of 400 kPa so as to maintain the command value of the spray amount of 0%. Specifically, the calculation processing unit 21*a*A sets the air pressure command value to 580 kPa. Thus, the control valve 23*a*A controls the water pressure to be 400 kPa. The air pressure control unit 22*a* controls the air pressure to be 580 kPa. When changing the water pressure command value, the calculation processing unit 21*a*A may determine the water pressure command value also in view of a particle size (for example, an average particle size) of a spray particle.

From the above control, the air pressure is reduced from 700 kPa to 580 kPa, and the air amount is reduced from 35 NL/min to 30 NL/min.

According to this embodiment, in addition to the effect of the first embodiment, the water pressure is controlled to be reduced, thereby allowing the air pressure and the air amount to be reduced without changing the spray amount. Also, the water supply apparatus 3 supplies water at maximum pressure required by all the spray control units 2*a*A, 2*b*A, and thus the spray control units 2*a*A, 2*b*A require no means for increasing the pressure. Thus, operational and facility costs of the two fluid spray equipment 10A can be reduced.

Third Embodiment

Figure 5:
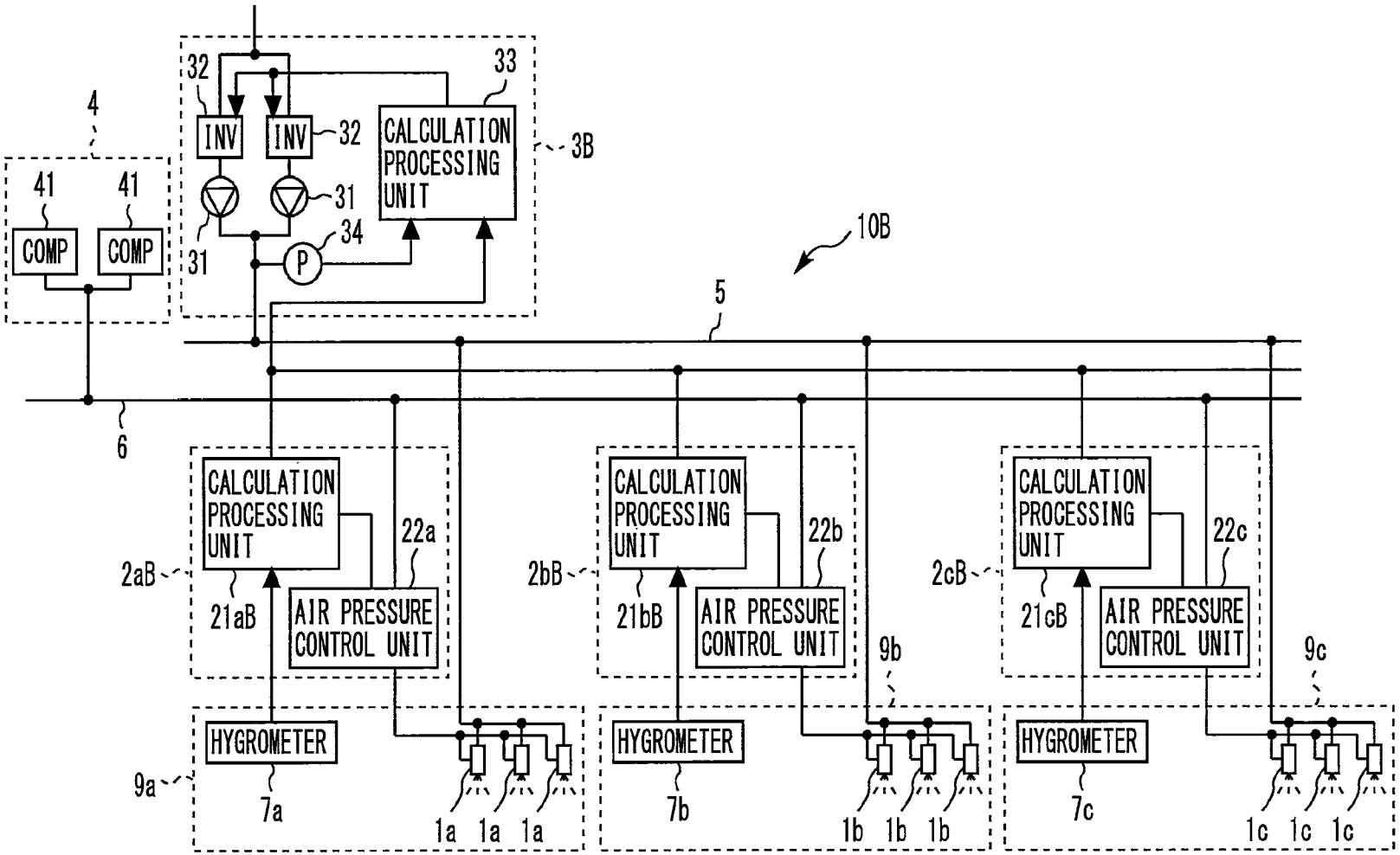
FIG. 5 shows a configuration of a two fluid spray equipment according to a third embodiment of the present disclosure.

FIG. 5 shows a configuration of a two fluid spray equipment 10B according to a third embodiment of the present disclosure.

The two fluid spray equipment 10B includes C-system spray control added, a water supply apparatus 3B instead of the water supply apparatus 3, spray control units 2*a*B, 2*b*B instead of the spray control units 2*a*, 2*b*, a C-system spray control unit 2*c*B, and two fluid nozzles 1*c* and a hygrometer 7*c* provided in a C-system space 9*c* added in the two fluid spray equipment 10 according to the first embodiment in FIG. 1. Other points are similar to those in the two fluid spray equipment 10 according to the first embodiment.

The water supply apparatus 3B includes two water supply pumps 31, two inverters 32, a calculation processing unit 33, and a water pressure measuring device 34. In the water supply apparatus 3B, devices are duplexed but do not need to be duplexed as in the first embodiment.

The inverters 32 are connected to the water supply pumps 31, respectively. The inverter 32 controls water pressure output from the water supply pump 31 with high accuracy. The inverter 32 controls the water pressure of the water supply pump 31 based on a control command value output from the calculation processing unit 33.

The water pressure measuring device 34 measures water pressure output from the water supply apparatus 3B (two water supply pumps 31). The water pressure measuring device 34 outputs the measured water pressure to the calculation processing unit 33.

The calculation processing unit 33 receives spray information for the spray control units 2*a*B to 2*c*B to control spray. The spray information relates to a property of mist sprayed from the two fluid nozzles 1*a* to 1*c* of the respective systems. For example, the spray information includes a spray amount or a particle size (for example, an average particle size) of a spray particle. The calculation processing unit 33 determines a water pressure command value based on the spray information. The calculation processing unit 33 outputs the control command value to the inverter 32 so that the water pressure output from the water supply apparatus 3B becomes the determined water pressure command value. The calculation processing unit 33 transmits the water pressure measured by the water pressure measuring device 34 to the spray control units 2*a*B to 2*c*B.

The A-system spray control unit 2*a*B includes a calculation processing unit 21*a*B instead of the calculation processing unit 21*a* and eliminates the valve 23*a* and the water pressure measuring device 24*a* in the A-system spray control unit 2*a* according to the first embodiment. Thus, the water supplied from the water supply apparatus 3B is supplied as it is to the A-system two fluid nozzle 1*a*. Other points are similar to those in the A-system spray control unit 2*a* according to the first embodiment.

The B-system spray control unit 2*b*B and the C-system spray control unit 2*c*B are configured similarly to the A-system spray control unit 2*a*B, and thus the A-system spray control unit 2*a*B will be mainly described below.

The calculation processing unit 21*a*B generates spray information for controlling spray of the A-system two fluid nozzle 1*a* based on humidity measured by the hygrometer 7*a*. The spray information may be determined by any method similarly to the command value of the spray amount in the first embodiment. The calculation processing unit 21*a*B outputs the generated spray information to the calculation processing unit 33 of the water supply apparatus 3B. The calculation processing unit 21*a*B generates an air pressure command value based on the generated spray information and outputs the air pressure command value to the air pressure control unit 22*a*.

FIG. 6 shows a relationship among a spray amount, water pressure, air pressure, an air amount, and an average particle size used by the calculation processing unit 33 according to this embodiment. FIG. 6 shows data of the average particle size in addition to the relationship in FIG. 4.

The A-system spray control unit 2*a*B controls the spray amount to 25% (25 mL/min), the B-system spray control unit 2*b*B controls the spray amount to 50%, the C-system spray control unit 2*c*B controls the spray amount to 75%.

An evaporation time of mist varies according to a particle size of the mist, and becomes shorter with decreasing particle size. Here, the average particle size of 10 μm or less is required in each system.

With reference to FIG. 6, to obtain the average particle size of 10 μm or less, water pressure of 400 kPa or more is required for the spray amount of 25%, water pressure of 450 kPa is required for the spray amount of 50%, and water pressure of 450 kPa or more is required for the spray amount of 75%.

Thus, at the water pressure of 450 kPa, the spray amount may be set to any of 25%, 50%, and 75% with the average particle size of 10 μm or less. Then, the calculation processing unit 33 determines the water pressure command value so that the water supply apparatus 3B supplies water at the pressure of 450 kPa.

In this embodiment, the calculation processing unit 33 of the water supply apparatus 3B is described to receive the spray information from the spray control units 2*a*B to 2*c*B. However, the calculation processing unit 33 may receive water pressures requested by the spray control units 2*a*B to 2*c*B as information instead of the spray information. In this case, the spray control units 2*a*B to 2*c*B determine required water pressures according to the contents of the spray control (the spray amount or average particle size, or the like), and transmits the water pressures to the calculation processing unit 33. The calculation processing unit 33 may determine, as the water pressure command value, the highest water pressure among the water pressures requested by the spray control units 2*a*B to 2*c*B.

In this embodiment, the apparatus that controls the water pressure with high accuracy is provided as the water supply apparatus 3B that supplies water to each spray control system, and thus the accuracy of pressure of the water to be supplied to the two fluid nozzles 1*a* to 1*c* can be increased without control of the water pressure by each spray control system.

Also, varying the supply pressure of the water supply apparatus 3B according to the current situation of each spray control system can minimize the water pressure. Thus, the operation at the low water pressure can reduce the air amount of the released compressed air, and reduce total consumption of air.

For example, in FIG. 6, for the spray amount of 100%, the water pressure of 500 kPa or more is required to obtain the average particle size of 10 μm or less. Thus, if the supply pressure of the water supply apparatus 3B is fixed, the supply pressure needs to be 500 kPa or more. On the other hand, in this embodiment, the water can be supplied at the pressure of 450 kPa according to the current situation as described above.

A command value of the supply pressure of the water supply apparatus 3B may be determined by any method. For example, the command value of the supply pressure may be determined by any of information on water in the air such as absolute humidity, relative humidity, or a dew point of outside air. The command value of the supply pressure may be determined by time, date, or season. Further, the command value of the supply pressure may be preset, externally input, or a target output rate of the command value of the supply pressure may be determined in each system. The command value of the supply pressure may be determined based on a combination of these elements.

Fourth Embodiment

Figure 7:
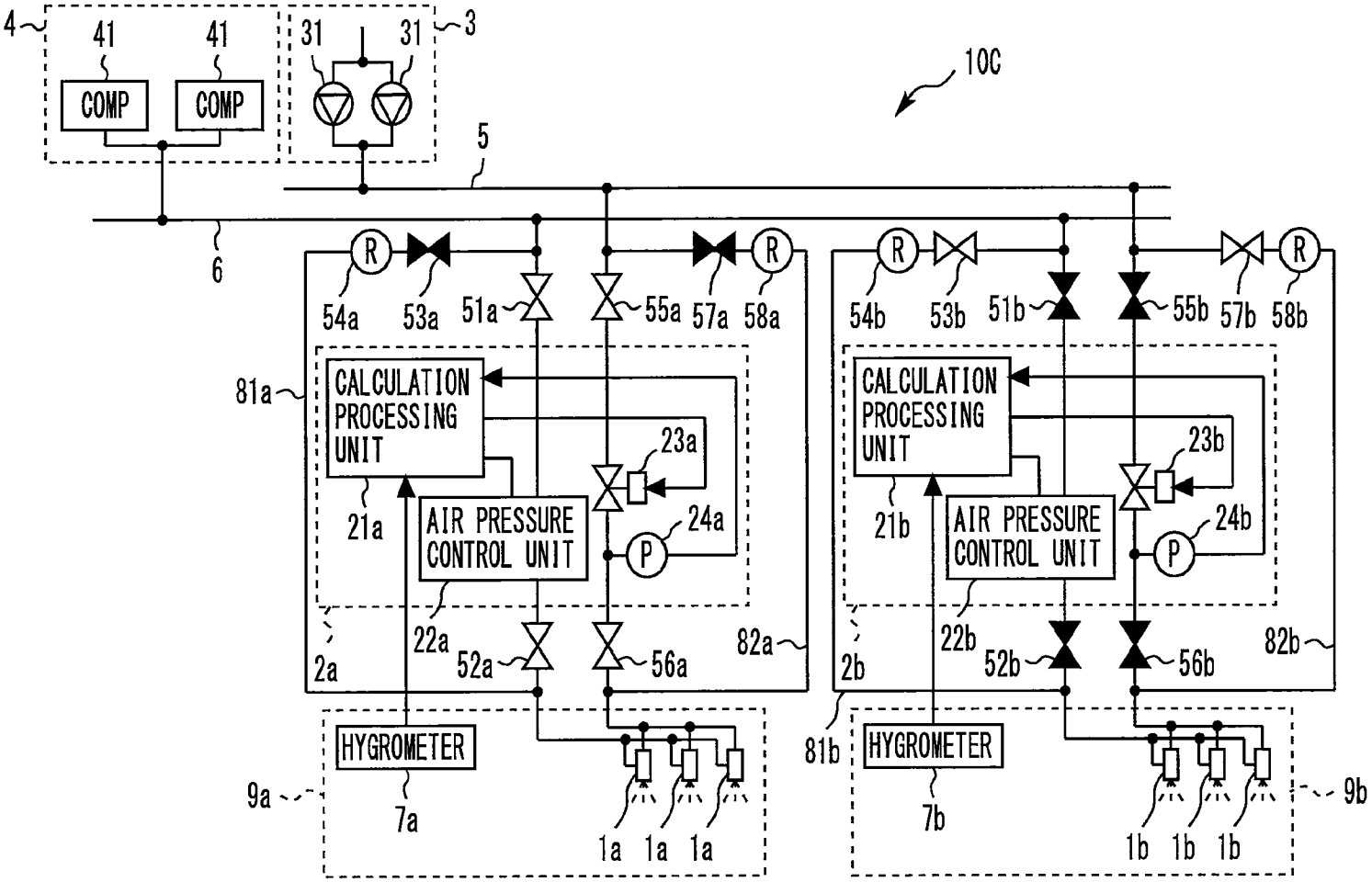
FIG. 7 shows a configuration of a two fluid spray equipment according to a fourth embodiment of the present disclosure.

FIG. 7 shows a configuration of a two fluid spray equipment 10C according to a fourth embodiment of the present disclosure.

The two fluid spray equipment 10C includes bypass circuits 81*a*, 81*b* of the air supply passage 6 which bypass the spray control units 2*a*, 2*b*, and bypass circuits 82*a*, 82*b* of the water supply passage 5 which bypass the spray control units 2*a*, 2*b* added to the two fluid spray equipment 10 according to the first embodiment in FIG. 1. Other points are similar to those in the two fluid spray equipment 10 according to the first embodiment.

The bypass circuit 81*a* is an air supply passage that bypasses the A-system spray control unit 2*a*. The bypass circuit 81*a* includes three valves 51*a*, 52*a*, 53*a* and a regulator 54*a*. The bypass circuit 81*b* is an air supply passage that bypasses the B-system spray control unit 2*b*. The bypass circuit 81*b* includes three valves 51*b*, 52*b*, 53*b* and a regulator 54*b*.

The bypass circuit 82*a* is a water supply passage that bypasses the A-system spray control unit 2*a*. The bypass circuit 82*a* includes three valves 55*a*, 56*a*, 57*a* and a regulator 58*a*. The bypass circuit 82*b* is a water supply passage that bypasses the B-system spray control unit 2*b*. The bypass circuit 82*b* includes three valves 55*b*, 56*b*, 57*b* and a regulator 58*b*.

The B-system bypass circuits 81*b*, 82*b* are configured similarly to the A-system bypass circuits 81*a*, 82*a*, and thus the A-system bypass circuits 81*a*, 82*a* will be mainly described.

In FIG. 7, the A-system is not using the bypass circuits 81*a*, 82*a* (normal time), and the B-system is using the bypass circuits 81*b*, 82*b*.

The case of using the A-system bypass circuits 81*a*, 82*a* due to inspection or failure of the A-system spray control unit 2*a* will be described.

In the normal time, the four valves 51*a*, 52*a*, 55*a*, 56*a* are opened and the two valves 53*a*, 57*a* are closed.

When using the A-system bypass circuit 81*a*, the two valves 51*a*, 52*a* are closed to stop supply of compressed air from the compressed air supply apparatus 4 to the A-system spray control unit 2*a*. If the valve 53*a* is opened in this state, the compressed air bypasses the A-system spray control unit 2*a* and is supplied from the compressed air supply apparatus 4 to the two fluid nozzle 1*a*. The pressure of the compressed air is adjusted by the regulator 54*a*.

When using the A-system bypass circuit 82*a*, the two valves 55*a*, 56*a* are closed to stop supply of water from the water supply apparatus 3 to the A-system spray control unit 2*a*. If the valve 57*a* is opened in this state, the water bypasses the A-system spray control unit 2*a* and is supplied from the water supply apparatus 3 to the two fluid nozzle 1*a*. The water pressure is adjusted by the regulator 58*a*.

In this embodiment, the configuration is described in which the bypass circuits 81*a*, 81*b*, 82*a*, 82*b* are applied to the two fluid spray equipment 10 according to the first embodiment, but the bypass circuit may be applied to the second or third embodiment as in this embodiment. In the third embodiment, the bypass circuit may be applied to the water supply apparatus 3B.

According to this embodiment, in addition to the effect of the first embodiment, the bypass circuits 81*a*, 81*b*, 82*a*, 82*b* are provided to allow manual spray control even when the spray control units 2*a*, 2*b* cannot be used due to inspection or failure.

Fifth Embodiment

Figure 8:
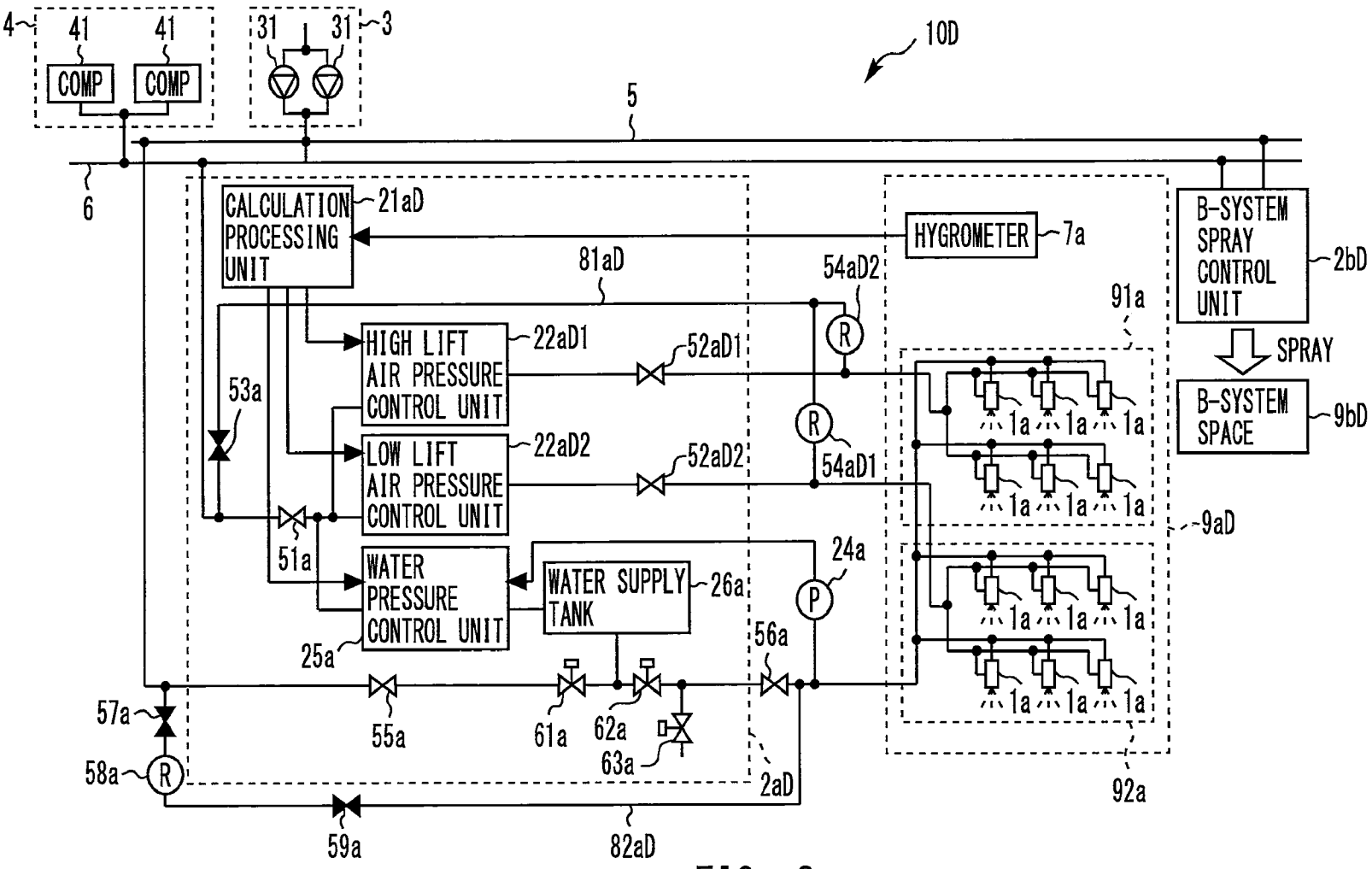
FIG. 8 shows a configuration of a two fluid spray equipment according to a fifth embodiment of the present disclosure.

FIG. 8 shows a configuration of a two fluid spray equipment 10D according to a fifth embodiment of the present disclosure.

The two fluid spray equipment 10D includes spray control units 2*a*D, 2*b*D instead of the spray control units 2*a*, 2*b*, and spaces 9*a*D, 9*b*D instead of the spaces 9*a*, 9*b* in the two fluid spray equipment 10 according to the first embodiment in FIG. 1. The A-system includes bypass circuits 81*a*D, 82*a*D for manual spray control as in the fourth embodiment, but does not need to include the bypass circuits 81*a*D, 82*a*D. Other points are similar to those in the two fluid spray equipment 10 according to the first embodiment.

The A-system space 9*a*D is divided into a high lift space 91*a* in which the two fluid nozzle 1*a* is provided in a high lift position and a low lift space 92*a* in which the two fluid nozzle 1*a* is provided in a low lift position. Also in this embodiment, all the two fluid nozzles 1*a* may be provided in the same space and controlled in the same manner as in the other embodiments. The B-system space 9*b*D is similar to the A-system space 9*a*D.

The A-system spray control unit 2*a*D includes a calculation processing unit 21*a*D, a high lift air pressure control unit 22*a*D1, a low lift air pressure control unit 22*a*D2, a water pressure measuring device 24*a*, a water pressure control unit 25*a*, a water supply tank 26*a*, and eight valves 51*a*, 52*a*D1, 52*a*D2, 55*a*, 56*a*, 61*a*, 62*a*, 63*a*. The valves 51*a*, 52*a*D1, 52*a*D2, 55*a*, 56*a* are manual valves manually operated. The valves 61*a*, 62*a*, 63*a* are electric valves automatically controlled. For example, openings of the valves 61*a*, 62*a*, 63*a* are controlled by command values calculated by the calculation processing unit 21*a*D. The B-system spray control unit 2*b*D is configured similarly to the A-system spray control unit 2*a*D, and thus the A-system spray control unit 2*a*D will be mainly described below.

The calculation processing unit 21*a*D is similar to the calculation processing unit 21*a* according to the first embodiment, and differences will be mainly described here.

The calculation processing unit 21*a*D calculates pressures of compressed air and water to be supplied to the A-system two fluid nozzle 1*a* based on a spray command value. The spray command value is determined based on humidity measured by the hygrometer 7*a*. The spray command value includes a command value of a spray amount, and may further include a command value of an average particle size of a spray particle. For example, the calculation processing unit 21*a*D may adopt any of the spray controls in the embodiments described above to calculate the spray command value, or use any of the relationships in FIGS. 2, 4 and 6 to calculate the spray command value.

The calculation processing unit 21*a*D generates a high lift air pressure command value and a low lift air pressure command value for controlling pressure of the compressed air based on the calculated air pressure. The high lift air pressure command value is lower than the low lift air pressure command value in view of a difference of elevation between the A-system two fluid nozzles 1*a* provided in the two spaces 91*a*, 92*a*. The calculation processing unit 21*a*D outputs the generated high lift air pressure command value to the high lift air pressure control unit 22*a*D1. The calculation processing unit 21*a*D outputs the generated low lift air pressure command value to the low lift air pressure control unit 22*a*D2. The calculation processing unit 21*a*D generates a water pressure command value for controlling water pressure based on the calculated water pressure. The calculation processing unit 21*a*D outputs the generated water pressure command value to the water pressure control unit 25*a*. The calculation processing unit 21*a*D may receive the water pressure measured by the water pressure measuring device 24*a* and use the measured water pressure to calculate the water pressure command value.

The high lift air pressure control unit 22*a*D1 controls the pressure of the compressed air based on the high lift air pressure command value calculated by the calculation processing unit 21*a*D, and supplies the compressed air to the A-system two fluid nozzle 1*a* in the high lift space 91*a*. The low lift air pressure control unit 22*a*D2 controls the pressure of the compressed air based on the low lift air pressure command value calculated by the calculation processing unit 21*a*D, and supplies the compressed air to the A-system two fluid nozzle 1*a* in the low lift space 92*a*. The air pressure control units 22*a*D1, 22*a*D2 are, for example, electro-pneumatic regulators (automatic regulators).

The water supply tank 26*a* temporarily stores water to control the water pressure. To the water supply tank 26*a*, water is supplied from the water supply apparatus 3 through the valve 55*a* and the valve 61*a* in order. By the valve 61*a*, an appropriate amount of water is automatically supplied to the water supply tank 26*a*. The water stored in the water supply tank 26*a* is controlled in pressure. The water controlled in pressure is supplied from the water supply tank 26*a* through the valve 62*a* and the valve 56*a* in order to the all the A-system two fluid nozzles 1*a*. By the valve 62*a*, an appropriate amount of water is automatically supplied to the A-system two fluid nozzle 1*a*. The water in the water supply tank 26*a* is discharged through the valve 62*a* and the valve 63*a* in order. An amount of discharged water is automatically adjusted by the valve 63*a*.

The water pressure measuring device 24*a* measures the pressure of the water to be supplied to the A-system two fluid nozzle 1*a*. The water pressure measuring device 24*a* transmits the measured water pressure to the water pressure control unit 25*a*.

The water pressure control unit 25*a* performs control to reduce the pressure of the water stored in the water supply tank 26*a* using the pressure of the compressed air supplied from the compressed air supply apparatus 4, so that the water pressure measured by the water pressure measuring device 24*a* conforms to the water pressure command value calculated by the calculation processing unit 21*a*D. Here, the pressure of the water supplied from the water supply apparatus 3 is controlled to be always higher than the water pressure command value calculated by the calculation processing unit 21*a*D. The water pressure control unit 25*a* is, for example, an electro-pneumatic regulator (automatic regulator). The water pressure control unit 25*a* only performs control to reduce the water pressure, and does not need to have a pressurizing function. The water pressure control unit 25*a* may perform control only with the water pressure command value without using the water pressure measuring device 24*a* if it can perform control so that the water pressure conforms to the water pressure command value.

Next, the bypass circuits 81*a*D, 82*a*D will be described. The bypass circuits 81*a*D, 82*a*D are similar to the bypass circuits 81*a*, 82*a* according to the fourth embodiment, and thus differences will be mainly described here.

The bypass circuit 81*a*D is an air supply passage that bypasses the A-system spray control unit 2*a*D. The bypass circuit 81*a*D includes a valve 53*a*, a high lift regulator 54*a*D1, and a low lift regulator 54*a*D2.

The bypass circuit 82*a*D is a water supply passage that bypasses the A-system spray control unit 2*a*D. The bypass circuit 82*a*D includes two valves 57*a*, 59*a* and a regulator 58*a*.

In FIG. 8, the A-system bypass circuits 81*a*D, 82*a*D are not used (normal time). In the normal time, the five valves 51*a*, 52*a*D1, 52*a*D2, 55*a*, 56*a* are opened and the three valves 53*a*, 57*a*, 59*a* are closed.

When using the A-system bypass circuit 81*a*D, the three valves 51*a*, 52*a*D1, 52*a*D2 are closed to stop supply of compressed air from the compressed air supply apparatus 4 through the A-system spray control unit 2*a*D to the two fluid nozzle 1*a*. If the valve 53*a* is opened in this state, the compressed air bypasses the A-system spray control unit 2*a*D and is supplied from the compressed air supply apparatus 4 through the regulators 54*a*D1, 54*a*D2 to the two fluid nozzle 1*a*. The pressure of the compressed air to be supplied to the high lift space 91*a* is adjusted by the regulator 54*a*D1. The pressure of the compressed air to be supplied to the low lift space 92*a* is adjusted by the regulator 54*a*D2.

When using the A-system bypass circuit 82*a*D, the two valves 55*a*, 56*a* are closed to stop supply of water from the water supply apparatus 3 through the A-system spray control unit 2*a*D to the two fluid nozzle 1*a*. If the two valves 57*a*, 59*a* are opened in this state, the water bypasses the A-system spray control unit 2*a*D and is supplied from the water supply apparatus 3 through the regulator 58*a* to the two fluid nozzle 1*a*. The water pressure is adjusted by the regulator 58*a*.

According to this embodiment, the water pressure control unit 25*a* using the automatic regulator or the like with high accuracy of pressure rather than an electric valve or the like controls the water pressure, thereby allowing control with high reliability. Also, the water pressure control unit 25*a* only performs control to reduce the pressure, thereby allowing a pressurizing function to be omitted and providing an inexpensive configuration.

For example, if the electric valve is used to control water pressure, the number of times of operation of the electric valve may be increased (for example, hundreds of thousands of times) to accommodate variations in pressure of water to be supplied, accommodate control errors, or improve accuracy. This also requires measures for operating life of the electric valve. On the other hand, using the automatic regulator or the like as in this embodiment does not cause such a problem.

The spray control units 2*a*D, 2*b*D can control the water pressure and the air pressure with high accuracy. Thus, even if pressure control of one of water and air cannot be performed due to inspection or failure, pressure control of the other can compensate therefor. Thus, even with one pressure control only, the spray control can be continued. For example, in the spray control, the air pressure may be controlled in proportion to the spray command value at the fixed water pressure, or the water pressure may be controlled in proportion to the spray command value at the fixed air pressure.

The bypass circuits 81*a*D, 82*a*D are provided to allow manual spray control as backup.

In this embodiment, the pressure of the compressed air to be supplied to the high lift two fluid nozzle 1*a* is different from that to be supplied to the low lift two fluid nozzle 1*a*, but the pressure of the water to be supplied may be different instead. In this case, the two air pressure control units 22*a*D1, 22*a*D2 are integrated, and the water pressure control unit 25*a* is separated into a high lift water pressure control unit and a low lift water pressure control unit, thereby allowing spray of the two fluid nozzle 1*a* to be controlled as in this embodiment.

In this embodiment, the spray control units 2*a*D, 2*b*D may be multiplexed. This can improve reliability of the system.

In this embodiment, the water pressure measured by the water pressure measuring device 24*a* is used only for the control of the water pressure by the water pressure control unit 25*a*, but may be used for the control of the air pressure by the air pressure control units 22*a*D1, 22*a*D2 as in the other embodiments. For example, control may be performed so that the air pressure is corrected according to actual water pressure.

The present disclosure is not limited to the above described embodiments, but may be embodied with modified components without departing from the gist of the present disclosure. The plurality of components disclosed in the above described embodiments may be combined in a suitable manner to achieve various disclosures. For example, some components may be eliminated from all the components disclosed in the embodiments. Further, the components in the different embodiments may be combined in a suitable manner.

The invention claimed is:

1. A two fluid spray equipment comprising:

two fluid nozzles of a plurality of systems for mixing and spraying pressurized water and a compressed gas;

pressurized water supply for supplying the pressurized water to the two fluid nozzles of the plurality of systems from a common pressurized water source;

compressed gas supply for supplying the compressed gas at common pressure to the two fluid nozzles of the plurality of systems from a common compressed gas source; and a plurality of spray control circuits provided in each of the plurality of systems for controlling a spray amount of the two fluid nozzle of each of the plurality of systems, wherein each of the plurality of spray control circuits is configured to control pressure of the compressed gas supplied from the compressed gas supply based on a spray command value for controlling the spray amount, and the pressurized water supply is configured to:

obtain the spray amount from each of the plurality of spray control circuits, determine required water pressure required by each of the plurality of spray control circuits according to the spray amount obtained from each of the plurality of spray control circuits;

set a water pressure command value to a highest water pressure among the required water pressures from each of the plurality of spray control circuits, and control water pressure of a water supply pump for supplying the pressurized water based on the water pressure command value.

2. The two fluid spray equipment according to claim 1, wherein, on condition that a spray control circuit of the plurality of spray control circuits cannot perform one of control of water pressure and control of pressure of the compressed gas, the spray control circuit is configured to fix one pressure and control the other pressure based on the spray command value.

3. The two fluid spray equipment according to claim 1, comprising:

compressed gas supply bypass for bypassing at least one of the plurality of spray control circuits and supplying the compressed gas to the two fluid nozzles to be controlled by the bypassed spray control circuit; and gas pressure adjustment for adjusting pressure of the compressed gas supplied from the compressed gas supply bypass.

4. The two fluid spray equipment according to claim 1, comprising:

pressurized water supply bypass for bypassing at least one of the plurality of spray control circuits and supplying the pressurized water to the two fluid nozzles to be controlled by the bypassed spray control circuit; and water pressure adjustment for adjusting pressure of the pressurized water supplied from the pressurized water supply bypass.

5. The two fluid spray equipment according to claim 1, wherein the pressurized water supply includes an inverter connected to the water supply pump.

6. The two fluid spray equipment according to claim 5, wherein the pressurized water supply includes water pressure control circuitry configured to control the inverter connected based on the water pressure command value.

* * * * *